US006196762B1

(12) United States Patent
Stude

(10) Patent No.: US 6,196,762 B1
(45) Date of Patent: Mar. 6, 2001

(54) NON-CLOGGING DEBRIS AND SEDIMENT REMOVAL FACILITY

(76) Inventor: Carl T. Stude, 1252 Takara Ct., St. Louis, MO (US) 63131

( * ) Notice: Subject to any disclaimer, the term of this patent is extended or adjusted under 35 U.S.C. 154(b) by 0 days.

(21) Appl. No.: 09/356,958

(22) Filed: Jul. 19, 1999

(51) Int. Cl.[7] ..... E02B 3/00; E02B 3/10; E02B 7/02

(52) U.S. Cl. ..... 405/80; 405/87; 405/107; 405/118; 405/119; 210/154

(58) Field of Search ..... 405/118, 119, 405/120, 121, 268, 124, 125, 127, 80, 84, 36, 107, 81, 83, 87; 210/154, 170, 294, 295, 299, 159, 747; 404/2

(56) References Cited

U.S. PATENT DOCUMENTS

| | | | | |
|---|---|---|---|---|
| 952,023 | * | 3/1910 | Tyler | 405/118 |
| 2,073,610 | * | 3/1937 | Danel | 405/118 |
| 2,500,452 | * | 3/1950 | Coffee | 405/118 |
| 3,772,891 | * | 11/1973 | Raistakka | 405/83 |
| 4,064,048 | * | 12/1977 | Downs et al. | 405/81 |
| 4,167,358 | * | 9/1979 | Besha | 405/87 |
| 4,437,431 | * | 3/1984 | Koch | 405/81 |
| 4,780,199 | * | 10/1988 | Ezzell et al. | 210/159 |
| 5,489,163 | * | 2/1996 | Thomann | 405/118 |
| 5,730,862 | * | 3/1998 | Mahr | 210/159 |
| 5,769,240 | * | 6/1998 | Middour et al. | 209/314 |
| 5,795,467 | * | 8/1998 | Schloss et al. | 405/87 |
| 5,895,579 | * | 4/1999 | Schloss et al. | 210/170 |
| 6,010,013 | * | 1/2000 | Brauch et al. | 210/154 |

FOREIGN PATENT DOCUMENTS

| | | | | |
|---|---|---|---|---|
| 1012512 | * | 7/1952 | (FR) | 405/119 |
| 1129618 | * | 10/1958 | (FR) | 405/119 |
| 510298 | * | 1/1955 | (IT) | 405/119 |
| 368016716 | * | 2/1981 | (JP) | 210/154 |

OTHER PUBLICATIONS

"Design Considerations for Small Earthfill Dams" by Alan Boom, published Jan. 20, 1998 for Canadian Dam Association.*

* cited by examiner

*Primary Examiner*—William Neuder
*Assistant Examiner*—Alexandra K. Pechhold
(74) *Attorney, Agent, or Firm*—Polster, Lieder, Woodruff & Lucchesi, L.C.

(57) ABSTRACT

A non-clogging facility (10) collects debris and sediment carried by water flowing in an open channel (DC) upstream of an inlet (I) to a conduit. A first section (12) provides a transition from the open channel into a second section (13) which allows for collection of large debris and readily settleable sediment. A barrier (16) comprises a base (18) extending from a sidewall (W1) on one side of the channel, substantially across the width of the channel, toward the opposite sidewall (W2). An opening (20) is provided between the end of this barrier and the opposite sidewall. Water flowing at a low rate is diverted through the opening into a bypass channel (22) to flow to the inlet through a third section (14). At higher flow rates, water flows over the barrier and through a screen formed by a series of spaced posts (26) extending the length of the barrier. Sediment settles to a floor (F) of the channel upstream of the barrier and is blocked by the barrier from moving further downstream. Larger debris is captured by the screen. If the screen becomes substantially obstructed by debris, a portion of the water flow is diverted through the bypass channel. This prevents the water level in the channel from substantially rising.

20 Claims, 5 Drawing Sheets

NON-CLOGGING DEBRIS AND SEDIMENT REMOVAL FACILITY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to systems for the conveyance of storm water runoff or water of other origin which sometimes carries debris and sediment, and more particularly, to a facility for removing such debris and sediment from open channels in such a system.

Systems for conveying untreated water such as storm water runoff typically incorporate both open channels and enclosed conduits. The open channels are either waterways in essentially their natural condition, or waterways which have been improved by enlargement, straightening, paving, or other means to increase their hydraulic capacity and reduce erosion of their banks. The enclosed conduits include both short lengths of enclosed conduit (culverts) under embankments, and extended lengths of buried piping or other buried conduit (storm sewers, drains, and transmission mains).

Runoff from unpaved land that enters a water conveyance system typically carries amounts of debris (such as tree limbs and discarded manufactured objects) and sediment (soil particles and rocks). Quantities of debris and sediment transported by the water increase with the water flow rate, and high rates of flow can carry quantities of these materials that may substantially interfere with operation of the conveyance system. Debris tends to be trapped and accumulate wherever there is an obstruction in the flow path, or a reduction in the size of the flow path. Sediment tends to deposit wherever the velocity of flow is reduced, either by enlargement of the channel cross-section or by eddy effects. In either instance, the hydraulic capacity of the conveyance system is reduced where the debris or sediment accumulates, causing the water level upstream of that location to be higher at all rates of flow. This almost always leads to more frequent flood damage to property and will often cause increased hazard to human life.

Bridge crossings of stream channels, and culverts under embankments that cross stream channels, are hydraulic "choke points" that are especially susceptible to blockage by debris, and present an especially high risk to people's lives and property. Obstruction of a bridge opening or culvert by debris or sediment reduces its hydraulic capacity. During periods of high flow, this causes upstream water levels to rise to the level of the bridge or the top of an embankment, and the water to flow over the roadway. The force of the current can wash vehicles off of the roadway into the stream, and can wash out the bridge or embankment.

The debris and sediment that accumulates in storm sewers also reduces their hydraulic capacity. This causes low-lying areas in a watershed to flood during more frequent, less intense rainstorms. Removing debris and sediment from an enclosed conduit is generally much more difficult and costly than removing these materials from an open channel, because of the difficulty of access to an enclosed conduit.

BRIEF SUMMARY OF THE INVENTION

A primary object of the present invention is a facility in a water conveyance system to remove debris and sediment from the flow of water in an open channel of the system while directing the flow into an enclosed conduit or a constriction in the open channel. By preventing debris and sediment from being carried into downstream components of the system, the facility prevents obstruction of the downstream components that would otherwise increase the incidence of flooding. The facility thereby reduces the hazard to property and human life that is associated with flooding.

Another object of the facility is to detain relatively large quantities of debris and sediment while causing only a minor rise in the upstream water level. This is achieved by enlarging the cross section of the channel configuration to reduce the water flow velocity, while directing the flow into a barrier extending across part of the channel.

An upstream, or "approach" section of the facility consists of a length of open channel that gradually widens and transitions from the shape of the open channel upstream of the facility, to a cross section having an essentially flat bottom and essentially vertical walls. As the cross section widens, the velocity of flow during high flow events is reduced, causing readily-settleable sediment carried by the water, such as sand and rocks, to be deposited on the floor of the facility.

The walls of the approach section are configured to direct flow towards an elongated barrier that extends across most of the "center" section, perpendicular to the direction of the flow. The base of the barrier is a low wall or curb typically made of concrete. At times of low flow, the flow will be diverted around the barrier through a bypass channel, and continues through an "outlet" section of the facility to the downstream conveyance system. When the flow rate increases to a value determined by the height of the base of the barrier and other dimensions of the particular installation, the water level will rise and a portion of the flow will pass over the base of the barrier.

A vertical screen mounted on top the barrier screens large debris out of the flow. The screen may be posts set at regular intervals, or some type of mesh might also be utilized to screen out smaller debris. Mesh, however, clogs more rapidly and is more difficult to clean.

As the flow rate further increases, the momentum of the large rate of flow passing through the barrier will hydraulically block (and even reverse) flow in the bypass channel, causing the entire flow to pass through the screen along the top of the barrier. In addition to supporting the screen, the barrier base serves to block any further downstream movement of sediment that settles onto the floor of the facility upstream of the barrier.

If a substantial quantity of debris accumulates on the screen of the barrier, a moderate rise in the level of the water at the upstream face of the barrier will occur and will cause a portion of the flow to divert into the bypass channel. This bypass flow may carry some debris that would otherwise be screened out by the barrier. However, it is an object of the invention that the barrier will still be effective at trapping very large items of debris such as tree trunks because their momentum will carry them into the barrier.

A further object of the invention is to provide a facility that can be constructed using standard techniques which are therefore economical. The facility is adaptable to any channel configuration, whether straight or curved, and can be installed in either new or existing conveyance systems.

Another object of the invention is a facility requiring relatively infrequent maintenance by unskilled personnel. The facility contains no moving parts. Larger installations of the facility can incorporate a ramp to provide access for personnel and maintenance equipment, during periods of low flow, to areas of the facility where debris and sediment accumulate. A front-end loader, for example, would generally be used to remove debris and sediment from the larger installations.

Another object of the invention is to reduce the risk of drowning in a water conveyance system by providing a region of reduced flow velocity where a person trapped in the flow is more readily able to escape. Achievement of this object is enhanced by permanently mounting one or more ladders on the sidewalls of the facility.

In accordance with the invention, generally stated, a non-clogging facility in a water conveyancing system collects debris and sediment carried by water flowing in an open channel upstream of an inlet to a conduit. A first section of the facility provides a transition from the open channel into a second section which allows for collection of large debris and readily settleable sediment. A barrier formed in the section comprises a base extending from a sidewall on one side of the channel, substantially across the width of the channel, toward the opposite sidewall. An opening is provided between the end of this barrier and the opposite sidewall. Water flowing at a low rate is diverted through the opening into a bypass channel to flow to the inlet through a third section of the facility. At higher flow rates, water flows over the barrier and through a screen formed by a series of spaced posts extending the length of the barrier. Sediment settles to a floor of the channel upstream of the barrier and is blocked by the barrier from moving further downstream. Larger debris is captured by the screen. If the screen becomes substantially obstructed by debris, a portion of the water flow is diverted through the bypass channel. This prevents the water level in the channel from substantially rising. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
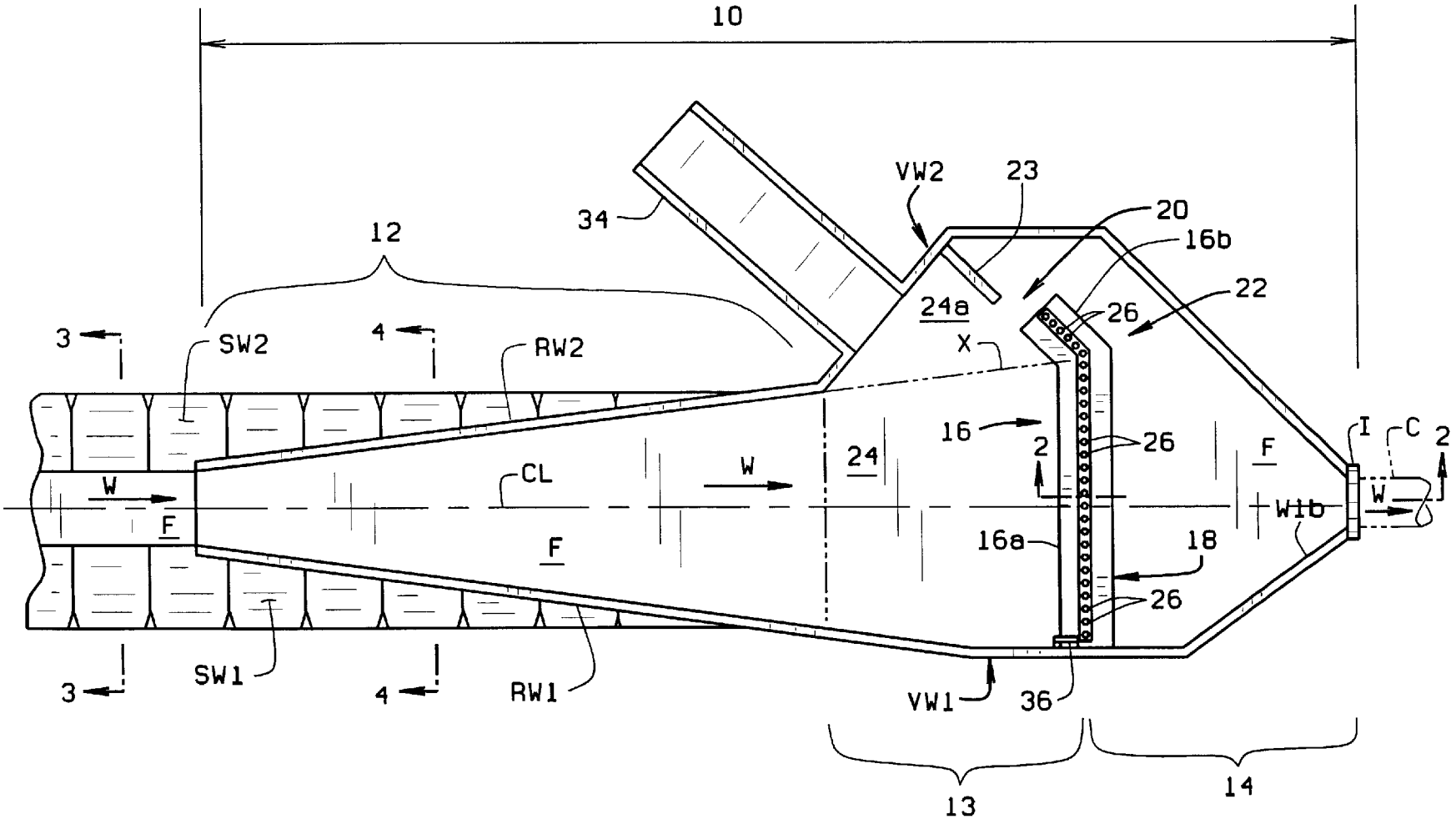
FIG. 1 is a plan view of an embodiment of the installation of the present invention.
Figure 1A:
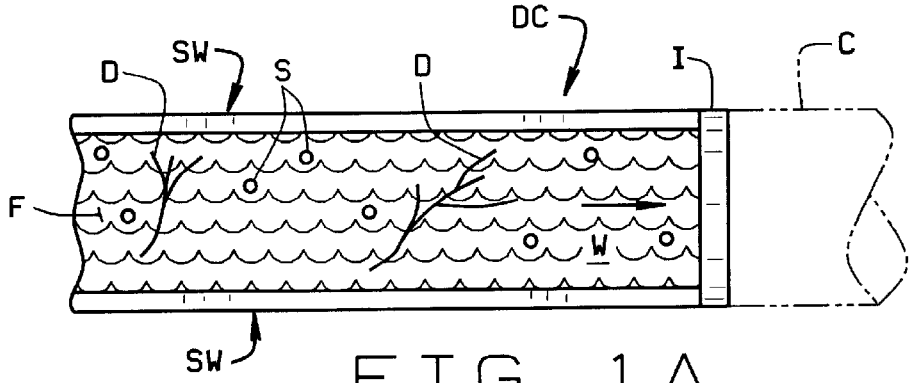
FIG. 1A PRIOR ART
Figure 1B:
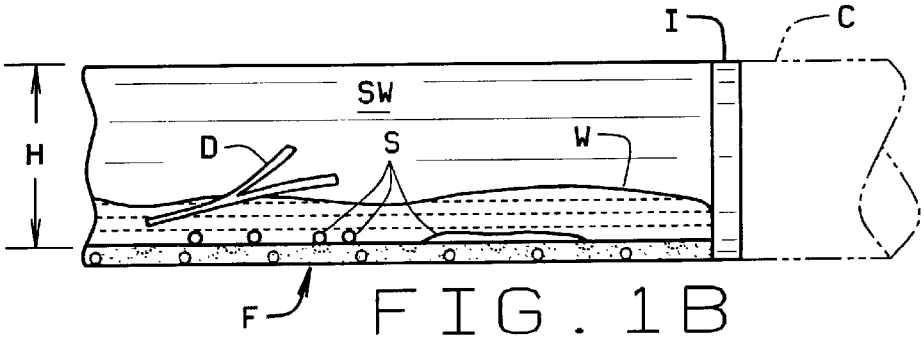
FIG. 1B PRIOR ART
Figure 1C:
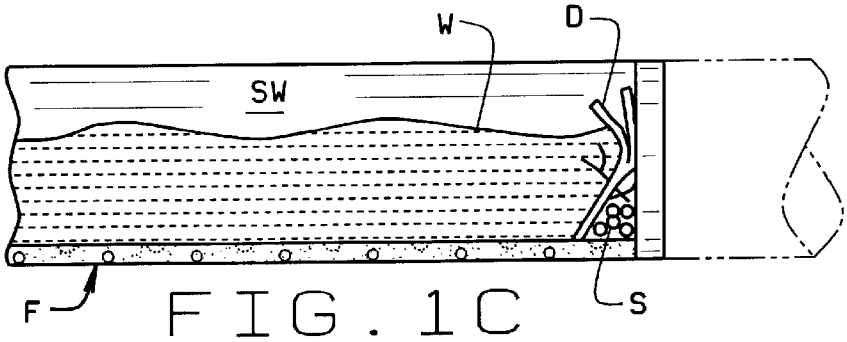
FIG. 1C PRIOR ART
Figure 1D:
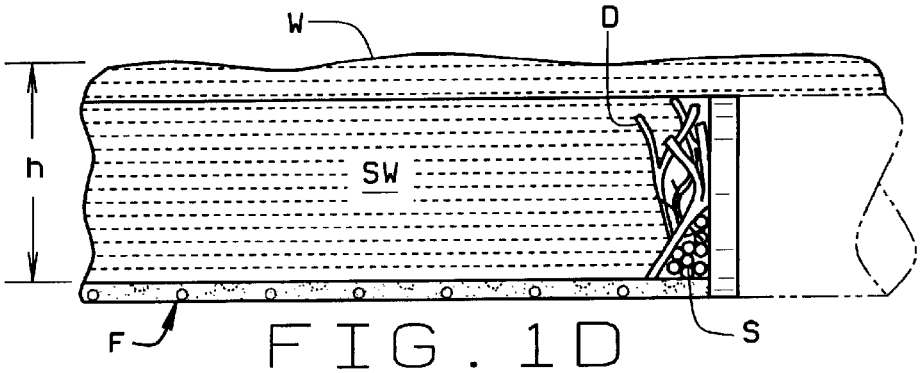
FIG. 1D PRIOR ART

Referring to the drawings, an inlet I to a culvert or other conduit C is shown in FIG. 1. Water W flow to the inlet is through a drainage channel DC which typically includes a floor F and sidewalls SW. Details of the construction of inlets to culverts and other conduits are well known in the art, and their construction will therefore not be described.

Water flowing through drainage channel DC at a depth HWU (see FIG. 2) periodically carries with it debris (not shown) such as tree limbs and manufactured objects. The water periodically carries sediment (also not shown) consisting of particles of soil and rocks. Debris larger than inlet I will become lodged at the inlet and trap smaller debris and sediment, substantially obstructing the inlet and causing a depth HWD of water upstream of the inlet (see also FIG. 2) to increase. At some rate of flow that is less than the capacity of the unobstructed inlet, the water surface will rise above the ground surface G, causing the water to overflow the channel and to flood adjacent and downstream areas.

As shown in FIG. 1, an installation 10 of the present invention provides a non-clogging facility which readily allows water to flow to inlet I and conduit C, without allowing large debris and readily-settleable sediment to reach the inlet. At the same time, the facility allows the debris and sediment to be detained in an area upstream of the inlet for ready removal. A very large amount of this material can be detained before the flow is substantially impeded. Facility 10 contains three sections. An "approach" section 12 provides a smooth, hydraulically efficient transition from upstream drainage channel DC to a "center" section 13, where large debris and readily-settleable sediment are removed from the flow and detained. The flow continues into an "outlet" section 14, which provides a smooth, hydraulically efficient transition to inlet I.

Figure 3:
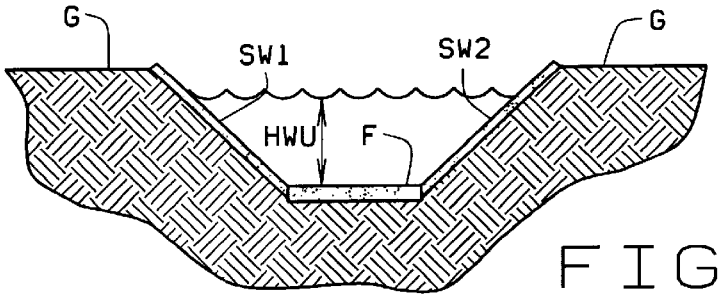
FIGS. 3 and 4 are respective elevational sectional views of the installation taken along lines 3—3 and 4—4 in FIG. 1.
Figure 4:
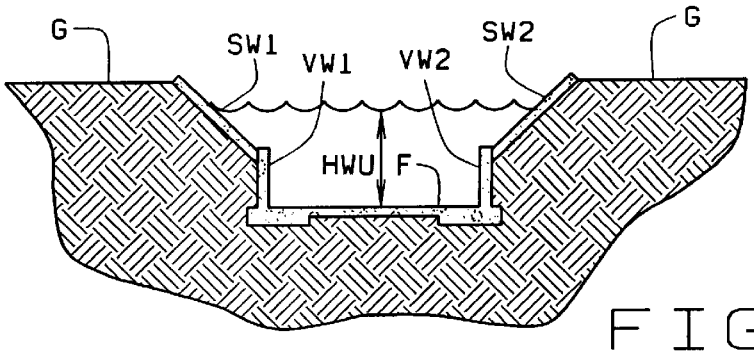

Approach section 12 slows the velocity of water flow and directs the flow towards a debris and sediment barrier 16 located in the center section 13 of the facility. FIG. 3 illustrates a cross-section of drainage channel DC upstream of the facility 10. The drainage channel is defined by a floor or bottom F, together with the respective sidewalls SW1 and SW2. At the location illustrated in FIG. 3, the sidewalls slope outwardly from the floor to upper ground surface G. Referring to FIG. 4, which is another cross-section within approach section 12 downstream of that shown in FIG. 3, sidewalls SW1 and SW2 continue in the downstream direction, but diminish in width as vertical retaining walls RW1 and RW2 respectively extend upward from the floor F. The width of each sloping sidewall tapers to zero at the downstream end of the approach section, and the vertical retaining walls now extend from the floor to the ground surface.

The overall length and width of approach section 12 varies depending upon the geometry of drainage channel DC and the maximum rate of water flow for which the channel is designed; however, it will be understood that the function of the approach section is to reduce the velocity of flow and provide a smooth transition from the drainage channel DC, whatever its configuration, into center section 13 of the facility. The angle at which vertical walls AW1 and AW2 flare out may vary according to the installation. However, each wall typically should flare out at no more than a 10° angle from a centerline CL of this section.

The downstream end of the approach section 12 connects to center section 13. This section has vertical sidewalls VW1 and VW2 respectively, substantially along its entire length. One of the sidewalls (VW2 in FIG. 1) flares out at an angle greater than 45° from centerline CL. Together with line X, which represents the projection of retaining wall AW2 into center section 13, this forms an area 24*a* that is outside of the main forward flow of water, under high flow conditions, because the momentum of the main forward flow carries it past area 24*a*.

Debris and sediment barrier 16 defines the downstream end of the center section 13. A main part 16*a* of the barrier extends generally perpendicular to centerline CL for most of the distance across the facility, such that at high rates of flow, the momentum of the current will carry the main forward flow of water from approach section 12 into the main part 16*a* of the barrier. At a point where barrier 16 is intersected by line X, the main part 16*a* of the barrier connects to extension 16*b* of the barrier. Extension 16*b* bends back upstream at an angle of approximately 45° to main part 16*a* of the barrier. Barrier extension 16*b* terminates at a distance away from wall VW2 to create an opening 20 for a bypass channel 22 in outlet section 14. An optional low curb 23 may be provided at the entrance to bypass channel 22 to narrow entrance 20 to the bypass channel for tighter channeling of the flow stream during periods of low flow.

Figure 2:
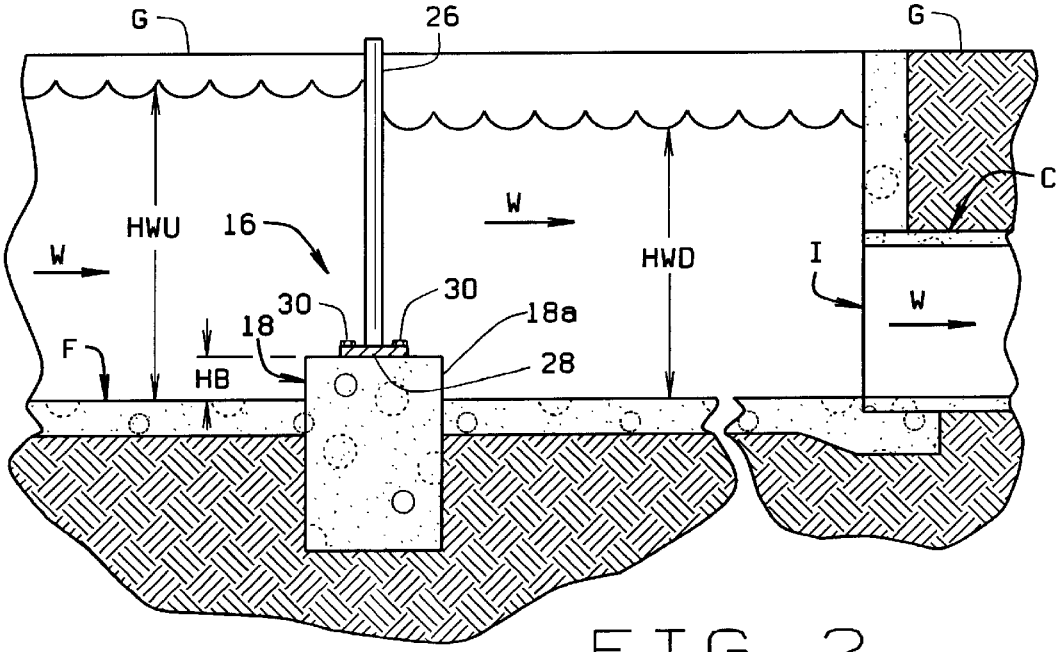
FIG. 2 is a sectional view taken along line 2—2 in FIG. 1.

Referring to FIG. 2, which illustrates a cross-section of barrier 16, the barrier is supported by a base 18 which is typically constructed of concrete. Base 18 protrudes above floor F by a height HB that is sufficient to block downstream movement of sediment and permit a substantial volume of sediment to be detained on floor F upstream of the barrier; i.e., on area 24 of the floor. Typically, height HB is approximately one foot (30 cm). Along the top of base 18, a line of vertical posts 26 are set at regular intervals in a way that allows water W to flow between the posts, but which causes large debris to be detained. The posts are typically spaced such that a clear space between them extends from 6 inches to 2 feet (15 to 61 cm), but not greater than half the least transverse dimension of downstream conduit C. The height of the posts is sufficient to place their tops above the maximum water level HWU that is anticipated to occur upstream of the barrier. It would be possible to attach a mesh to the posts to remove smaller debris from the flow, but this would necessitate a higher level of maintenance to remove the accumulated debris. In most cases, this level of maintenance would be considered excessive.

Under low flow conditions, the level of water upstream of barrier 16 is less than the height HB of base 18. At this time, the flow carries only minor quantities of debris and sediment, and this flow is blocked by barrier 16. The flow now passes around the end of barrier 16 into bypass channel 22. Under high flow conditions, the flow passes over base 18 of the barrier and between the posts 26. If an amount of debris accumulates on the barrier that is sufficient to substantially increase the headloss through it, a portion of this high flow will divert around the barrier through bypass channel 22. All of these shifts in the pattern of flow occur according to hydraulic principles of open channel flow and without the operation of any moving parts.

The length of main part 16*a* of the barrier, in conjunction with the spacing of posts 26, is sufficient to limit the velocity of the flow between the posts to not more than 5 feet per second (1.5 m/sec). The posts are structurally designed to withstand the maximum differential hydrostatic pressure between the upstream water depth HWU and the downstream water depth HWD that will occur as the result of headloss through or around the posts. In certain northern locations, the structural design should account for the force of floating ice on the upstream side of the posts. The posts must be firmly anchored to barrier base 18 by a method such as a base plate 28 attached by anchor bolts 30. The barrier base 18 must be designed to resist overturning and displacement by the forces on it and on the posts.

After passing around or through barrier 16, the flow enters outlet section 14 of the facility. The outlet section is formed by continuations of vertical walls VW1 and VW2, which walls converge to direct the water flow into inlet I. To reduce headloss as the flow enters inlet I, and avoid eddies where small debris would accumulate in outlet section 14, walls VW1 and VW2 should be at an angle of not more than 45° to the centerline of conduit C.

A feature of the facility shown in FIG. 1, and which may be provided in larger installations, is a ramp 34 that allows maintenance equipment such as a front end loader to be driven down into the center section 13 for periodic removal of accumulated sediment and debris. Finally, a ladder 36 is provided on sidewall VW1 upstream of where barrier 16 connects to it, to provide a means for a person caught in a high flow to escape from the facility and avoid drowning.

Figure 5:
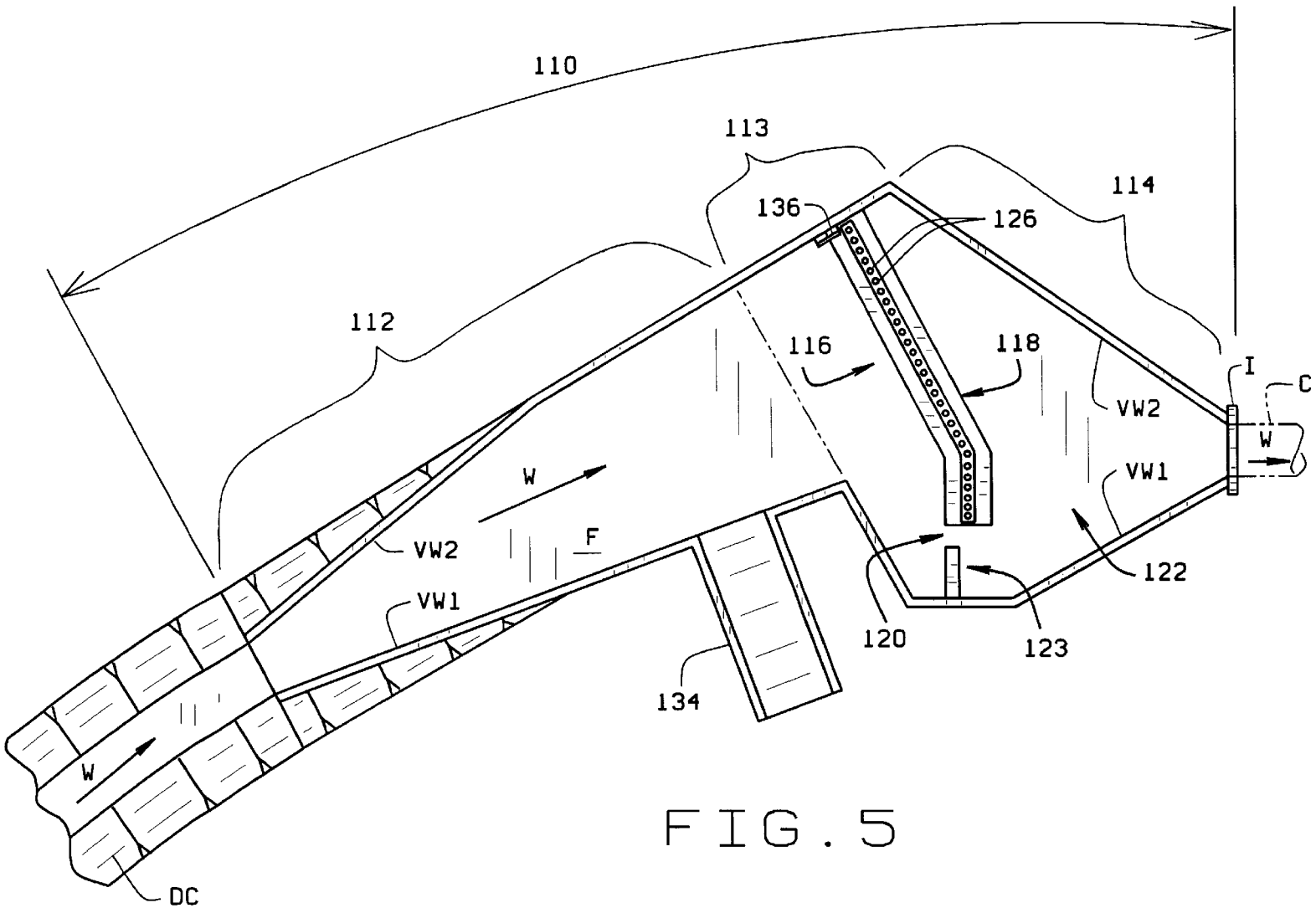
FIG. 5 is a plan view of one alternate construction of the system.

Referring to FIG. 5, a different configuration of the facility, indicated generally 110, is illustrated. This configuration is applicable to installations where the centerline of the upstream drainage channel DC forms a substantial angle with the centerline of the downstream conduit C. The facility includes an approach section 112, a center section 113, and an outlet section 114. A debris and sediment barrier 116 extends from the sidewall VW2 that is on the outside of the bend formed by the facility, most of the way across to sidewall VW1. Barrier 116 includes a base 118 and a set of vertical posts 126 mounted at regular intervals atop the base. There is a bypass channel 122 between the end of barrier 116 and sidewall VW1, with its entrance 120 constricted by an optional curb 123. In outlet section 114, sidewalls VW1 and VW2 converge to inlet I. Other optional features include an access ramp 134 and an escape ladder 136.

Figure 6:
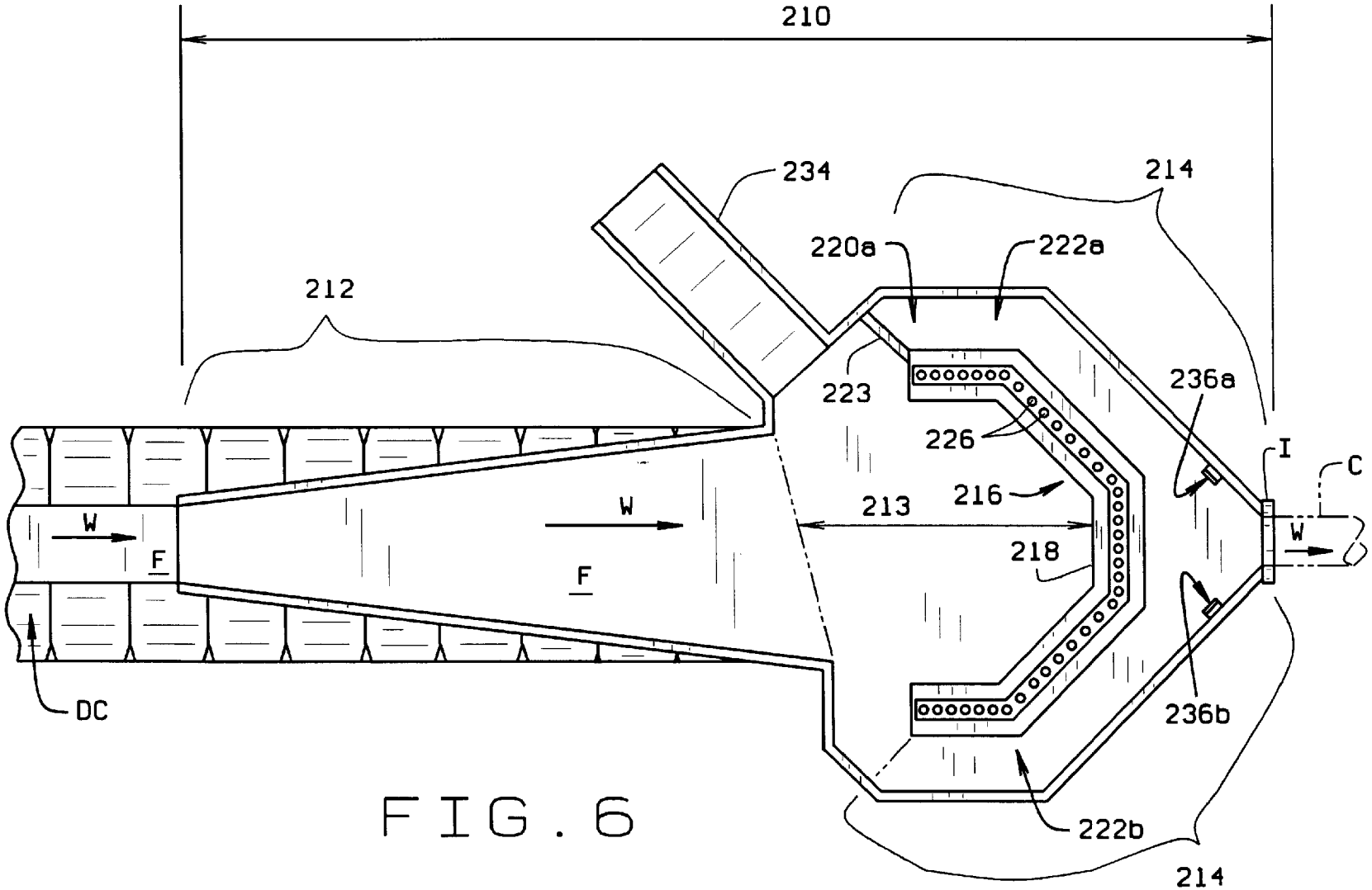
FIG. 6 is a plan view of second embodiment of the installation of the present invention.

Another configuration of the invention, shown in FIG. 6, is for a facility 210 that includes an approach section 212, a center section 213, and an outlet section 214. As with facility 10 shown in FIG. 1, facility 210 is installed where upstream drainage channel DC is aligned with downstream conduit C. The facility includes a debris and sediment barrier 216 that consists of posts 226 mounted atop a base 218. However, the debris and sediment barrier 216 in this configuration has a "U" shape and is set in the center of section 214, creating bypass channels 222*a* and 222*b* on each side of the barrier. The entrance to one of the bypass channels (entrance 220*a* in FIG. 6) is blocked by an optional low curb 223, causing the water to flow through the other bypass channel (222*b*) at low rates of flow. As before, other optional features include an access ramp 234 and escape ladders 236*a* and 236*b*.

What has been described is a non-clogging facility directing water flow from an open drainage channel into a culvert or other conduit while preventing debris and sediment carried with the water from obstructing an inlet into the culvert or conduit, so as to prevent water backup which could overflow the open channel. The facility is designed to provide more than one flow path for water to reach the inlet—one path for low rates of flow, and a second path for higher rates of flow which typically carry substantial amounts of debris and sediment. This facility includes a barrier to prevent debris and sediment from reaching the inlet, while allowing water to flow through the barrier to the inlet at higher rates of flow. The facility is usable with any channel configuration, whether straight or curved. Different variations of the facility can be used with various water conveyance systems. A ramp may be provided for access to larger installations so that accumulated debris and sediment can be removed by mechanical equipment.

The non-clogging facility is adaptable to be implemented in both new and existing systems using standard construction techniques.

In view of the foregoing, it will be seen that the several objects of the invention are achieved and other advantageous results are obtained.

As various changes could be made in the above constructions without departing from the scope of the invention, it is intended that all matters contained in the above description or shown in the accompanying drawings shall be interpreted as illustrative and not in a limiting sense.

What is claimed is:

1. A non-clogging facility for collecting debris and sediment carried by water flowing in a channel upstream of an inlet (the "downstream inlet") to a conduit or the like into which the channel drains, so to allow water to drain from the channel without the debris and sediment obstructing the downstream inlet, the facility comprising:

an approach section providing a transition from said channel into said facility;

a center section into which said approach section opens;

an outlet section providing a transition from said facility to said downstream inlet for water flowing through said facility to flow into said downstream inlet; and, a barrier blocking downstream movement of debris and sediment carried by the water between the center section and outlet section, said barrier extending substantially across a width of the facility from one side of the facility to an opposite side thereof, and at least one bypass channel being formed around the barrier for diversion of water, at low rates of flow, around said barrier from the center section into the outlet section with the debris and sediment carried by the water collecting upstream of said barrier and being substantially prevented from being carried by the water to said downstream inlet, but with water, at higher rates of flow, substantially flowing over the barrier into the outlet section rather than through the bypass channel but debris and sediment still collecting upstream of the barrier and not being carried into the downstream outlet.

2. The facility of claim 1 wherein said barrier incorporates a base of a predetermined height, said base extending substantially across the width of said facility, lower rates of water flow diverting around said base into said bypass channel, sediment carried by the water settling on a floor of said facility upstream of said barrier and not being further carried toward said downstream inlet.

3. The facility of claim 2 wherein said barrier further includes a screen surmounting said base with higher rates of water flow flowing over said base and through said screen to said downstream inlet, debris carried by the water collecting against the screen and not being carried by the water to said downstream inlet.

4. The facility of claim 3 wherein said screen includes a plurality of vertically extending posts spaced at intervals substantially along the length of said base for said debris to collect against said posts upstream of said downstream inlet.

5. The facility of claim 3 wherein said screen includes a vertically extending fence extending substantially the length of said base for said debris to collect against said fence upstream of said downstream inlet.

6. The facility of claim 1 wherein said approach section widens from an inlet end to an outlet end thereof so to reduce the velocity of water flowing through said approach section into said center section of said facility.

7. The facility of claim 6 wherein said approach section includes both sloping sidewalls and vertical retaining walls defining said approach section, said sidewalls beginning at an upstream end of said approach section and channeling water flow into said approach section, and said retaining walls beginning downstream of said upstream end of said approach section and extending the remaining length thereof to channel the flow of water, debris, and sediment through said approach section.

8. The facility of claim 7 wherein said center section increases in width at an upstream end thereof so to be wider than said outlet end of said approach section, said increase in width extending beyond a projection of one of said retaining walls defining said approach section into said center section, water flowing from said approach section into said center section flowing past a portion of said center section which is beyond said projection for sediment carried by the flow of water to collect in said portion of said center section.

9. The facility of claim 8 wherein said outlet section narrows in width from an inlet end to an outlet end thereof so to direct water flow into said downstream inlet in a hydraulically efficient manner.

10. The facility of claim 1 wherein said barrier is constructed in said center section of said facility.

11. The facility of claim 10 wherein said barrier has a first segment extending from said one side of said center section orthogonally of said center section, and a second segment extending toward said opposite side of said center section at an angle to said first segment.

12. The facility of claim 11 wherein said second barrier segment angles away from said first barrier segment at a location defined by an intersection of a line representing the projection of one retaining wall of said approach section and said first barrier segment, said second barrier section angling away from a downstream end of center section from said location of intersection.

13. The facility of claim 1 wherein said barrier comprises a curb of a predetermined height extending substantially across a width of said center section from a location adjacent one side of said center section to a location adjacent said opposite side thereof, an opening being formed between each respective end of said curb and an adjacent sidewall of said center section, said curb and said sidewalls of said center section respectively defining first and second bypass channels for water flow to said downstream inlet.

14. The facility of claim 1 further including accessing means accessing said facility to remove debris and sediment detained in said facility.

15. The facility of claim 14 wherein said accessing means includes a ramp allowing mechanical equipment to be employed in said facility to remove debris and sediment.

16. The facility of claim 15 wherein said accessing means further includes at least one escape ladder extending down into said facility for people to enter and leave the facility.

17. A non-clogging facility for collecting debris and sediment carried by water flowing in a channel upstream of an inlet (the "downstream inlet") to a conduit or the like into which the channel drains, so to allow water to drain from the channel without the debris and sediment obstructing the downstream inlet, the facility comprising:

an approach section providing a transition from said channel into said facility, said approach section widening from an inlet end to an outlet end thereof so to reduce the velocity of water of flowing through said approach section into said center section of said facility;

a center section into which said approach section opens, said center section substantially increasing in width at an upstream end thereof so to be wider than said outlet end of said approach section thereby to create a collection area for sediment carried by the flow of water from said approach section into said center section;

an outlet section providing a transition from said facility to said downstream inlet for water flowing through said facility to flow into said downstream Inlet, said outlet section narrowing in width from an inlet end to an outlet end thereof so to direct water flow into said downstream inlet in a hydraulically efficient manner; and, a barrier formed in said center section blocking downstream movement of debris and sediment carried by the water from said center section into said outlet section, said barrier extending substantially across a width of said center section from one side of said center section to an opposite side thereof, and at least one bypass channel being formed around the barrier for diversion of water, at low rates of flow, around said barrier from the center section into the outlet section with the debris and sediment carried by the water collecting upstream of said barrier and being substantially prevented from reaching said downstream inlet, but with water, at higher rates of flow, substantially flowing over the barrier into the outlet section rather than through the bypass channel, but debris and sediment still collecting upstream of the barrier and nothing carried into the downstream outlet.

18. A method of preventing obstruction of an inlet (the "downstream inlet") into a culvert or other conduit comprising:

directing water flow through a first section of a facility, the water carrying debris and sediment and said first section reducing the velocity of water flow;

directing water flow from said first section into a second section for sediment to collect in said second section, said second section including a barrier blocking flow of debris toward said downstream inlet;

directing water flow from said second section into a third section which directs water flow into said downstream inlet in a hydraulically efficient manner; and, providing at least one bypass channel around said barrier for diversion of water, at low rates of flow, around said barrier from said section into said third section with the debris and sediment carried by the water collecting upstream of said barrier and being substantially prevented from reaching said downstream inlet, but with water, at higher rates of flow, substantially flowing over the barrier into said third section rather than through the bypass channel, but debris and sediment still collecting upstream of the barrier and not being carried into the downstream inlet.

19. The method of claim 18 wherein said barrier includes a base blocking sediment movement at low rates of water flow, and a screen trapping debris carried by the water at higher rates of water flow.

20. The facility of claim 18 further including forming a second bypass channel around said barrier for water flow to said downstream inlet.

* * * * *